United States Patent [19]

Komaki

[11] 4,249,054

[45] Feb. 3, 1981

[54] METALLIC HOUSING FOR AN ELECTRONIC APPARATUS WITH A FLAT KEYBOARD

[75] Inventor: Shigeki Komaki, Yamatokoriyama, Japan

[73] Assignee: Sharp Kabushiki Kaisha, Osaka, Japan

[21] Appl. No.: 16,075

[22] Filed: Feb. 28, 1979

[30] Foreign Application Priority Data

Feb. 28, 1978 [JP] Japan ..... 53/26783[U]

[51] Int. Cl.[3] ..... H01H 3/12

[52] U.S. Cl. ..... 200/159 B; 200/340

[58] Field of Search ..... 200/159 R, 159 A, 159 B, 200/340, 5 A; 235/145 R

[56] References Cited

U.S. PATENT DOCUMENTS

| | | | |
|---|---|---|---|
| 440,813 | 11/1890 | Von Kohler | 200/159 B |
| 2,086,066 | 7/1937 | Churchill | 200/159 B |
| 3,627,935 | 12/1971 | Spievak | 200/340 X |
| 3,643,041 | 2/1972 | Jackson | 200/159 B X |
| 3,843,851 | 10/1974 | Harada et al. | 200/340 X |
| 3,860,771 | 1/1975 | Lynn et al. | 200/159 B X |
| 4,066,860 | 1/1978 | Kawasaki | 200/159 A X |

*Primary Examiner*—Stephen Marcus

*Attorney, Agent, or Firm*—Birch, Stewart, Kolasch & Birch

[57] ABSTRACT

An upper member of a housing and a plurality of key actuators are unified into a single flat sheet made by stainless steel. The respective ones of the key actuators are made movable by reducing the thickness of the corresponding limited regions of the stainless steel sheet. When a particular one of the key actuators is actuated, a movable contact on a conductive silicon rubber sheet will come into contact with a stationary contact on a circuit board.

8 Claims, 5 Drawing Figures

METALLIC HOUSING FOR AN ELECTRONIC APPARATUS WITH A FLAT KEYBOARD

BACKGROUND OF THE INVENTION

The present invention relates to an improvement in a keyboard construction and, more particularly to a keyboard construction adapted to unify an upper member of a housing for an electronic apparatus and a family of key actuators in the keyboard construction.

A conventional flat keyboard on an electronic apparatus such as a hand-held calculator includes a flexible sheet of plastic leather material constituting a plurality of movable key actuators, an upper member of a housing and a reinforcing frame for reinforcement of the flexible sheet and the upper member. The flexible sheet is sandwiched between the upper member and the reinforcing frame and secured tightly on the upper member. A sheet of nonconductive, elastic rubber and a circuit board are disposed beneath the flexible sheet. A plurality of conductive rubber bridging contacts are adhered to the nonconductive rubber sheet each corresponding in position to stationary contacts formed on the circuit board. The rubber sheet and the circuit board are secured within a lower member of the housing by a well known manner. The plastic leather sheet, however, is vulnerable to flaws and is difficult to restore from a depressed position to its initial one due to fatigue. Thus a more desirable material for the key actuator material is necessitated to overcome the deficiencies of the plastic leather sheet. Moreover, the use of plastic leather as the key actuator material is not compatible with indicia printing. As stated above, the reinforcing frame reinforces the actuator sheet and the upper member acts not to exert gravity of the nonconductive rubber sheet upon the actuator sheet. To make sure that a selected or depressed key in the key construction comes into effect for the introduction of inputs, the corresponding key actuator should be rather strongly actuated to pass through a central hole of the reinforcing frame. There is, however, a tendency for the actuator sheet to remain depressed due to fatigue even after the depression is released. Also, the appearance of the electronic apparatus is disfigured. In addition, a metallic sheet is needed within the keyboard construction for the purpose of shielding the keyboard construction against static electricity.

SUMMARY OF THE INVENTION

It is therefore on object of the present invention to provide an electronic apparatus with a flat keyboard which is free of at least one of the above suggested prior art disadvantages. According to the teachings of the present invention, a keyboard construction is adapted to unify a portion of a housing for an electronic apparatus such as a hand held calculator and a family of key actuators of a substantially flat keyboard into a single or common sheet. The key actuators integral with the portion of the housing is made of rigid durable metallic material. An appropriate metallic material for the key actuators is stainless steel. To make the key actuators movable in a vertical direction, selected regions of the housing/key actuator sheet corresponding to respective key actuators are markedly reduced in thickness, in one preferred form of the present invention. This can be accomplished by a well known method such as etching. The metallic housing/key actuator sheet is made useful for protection of the key construction against high static electricity by merely leading the same to a ground potential, thereby eliminating the need for a particular shield plate. It is further easy to print indicium or markings on the upper surface of the metallic housing/key actuator sheet for the respective key actuators by a well known method such as etching. A plurality of conductive, flexible rubber contacts are disposed beneath the metallic housing/key actuator sheet for up and down movement responsible to actuation of the key actuators. When a particular one of the key actuators is actuated, the corresponding conductive rubber contact comes into contact with a corresponding stationary contact disposed on a circuit board. In contrast to the metallic housing/key actuator sheet of the present invention the prior art key actuator made of plastic material experiences difficulties in tolerating repeated key actuations without exhibiting fatigue, printing indicium, and the electrostatically shielding of the key construction.

BRIEF DESCRIPTION OF THE DRAWINGS

The above and other objects and features of the invention will become apparent with reference to the following specification and to the drawings wherein.

DETAILED DESCRIPTION OF THE PREFERRED EMBODIMENTS

Figure 1:
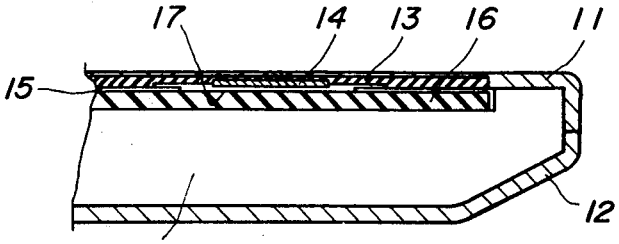
FIG. 1 is a cross sectional view of a housing with a keyboard embodying the present invention in its one preferred form.

Referring now to FIG. 1, there is illustrated one preferred embodiment of the present invention, which comprises an upper member 11 of a housing for an electronic apparatus such as a hand-held calculator made of metallic material such as stainless steel or the like. After deposition of etching resist material on selected regions of the metallic upper member 11, there are formed a plurality of key actuators of an extremely thin dimension (say, 0.025–0.03 mm). Then, the extremely thin key actuators integral with the upper member 11 is combined with a nonconductive silicon rubber sheet 13 and a conductive rubber sheet 14 as a unit. Comb-shaped stationary contacts 17 carried on a circuit board 16 are located beneath the conductive rubber sheet 14, via a spacer member 15 thereby completing the formation of a substantially flat keyboard construction. The conductive rubber sheet 14 bears a plurality of movable contacts which comes into contact with the comb-shaped stationary contacts. These components are secured between the upper member 11 and a lower member 12 of the housing via a reinforcing frame 18. The circuit board 16 is fixed on the reinforcing frame 18 with electrical isolation from the lower member 12 of the housing.

Figure 2A:
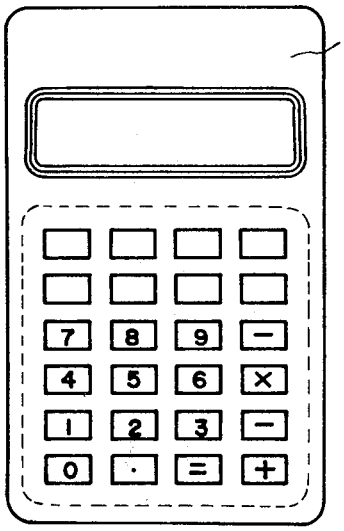
FIGS. 2(*a*) and 2(*b*) are front and rear views of an upper member of the housing according to the present invention.
Figure 2B:
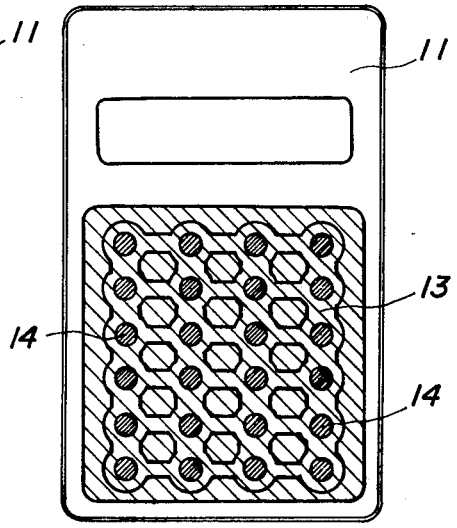

FIGS. 2(*a*) and 2(*b*) show an example of the upper member 11 of the housing where the conductive rubber sheet 14 and the nonconductive rubber sheet 13 are unified into a single unit. In FIG. 2(*a*), actuator indicium or markings such as digits 0 through 9 a decimal point and symbols =, ×, ÷, are printed on the stainless steel sheet 11 by a conventional method, for example, etching and printing. As seen from FIG. 2(*b*), the nonconductive silicon rubber sheet 13 carrying a plurality of circular conductive rubber contacts 14 is made integral with the stainless steel made housing upper member 11.

To manufacture the key construction embodying the present invention, a proper etching resist material is deposited on non-selected regions of the stainless steel sheet 11 of 0.3 mm thick for subsequent etching. Following the etching step the selected regions of the stainless steel sheet 11 are etched with the resulting thickness of 0.025–0.03 mm, which correspond to the respective ones of the key actuators, thereby making the key actuator regions movable in a vertical direction. The conductive and nonconductive material is attached to the key actuator regions as a unit, followed by pressing.

Figure 3:
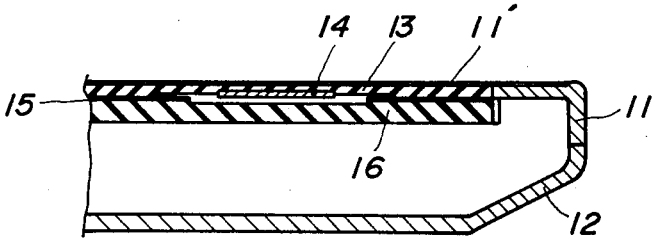
FIG. 3 is a cross sectional view of a preferred form of the present invention of FIGS. 1, 2(*a*) and 2(*b*)

Another preferred embodiment of the present invention is illustrated in FIG. 3. Although in the first named embodiment the extremely thin key actuators are formed by etching, in this case a second thin film 11' which is substantially same or similar to the stainless steel made sheet 11 is adhered or bonded to the stainless steel - made sheet 11, ensuring complete uniformity of the thickness of the overall keyboard construction. It is obvious to those skilled in the art that an alternative way to make the key actuator regions of the upper member of the housing movable is to form hinge members in close proximity of the key actuator regions during etching. It is desirable to lead the upper member 11 to the ground potential via a particular grounded component on the circuit board from an electrostatic protection point of view.

Figure 4:
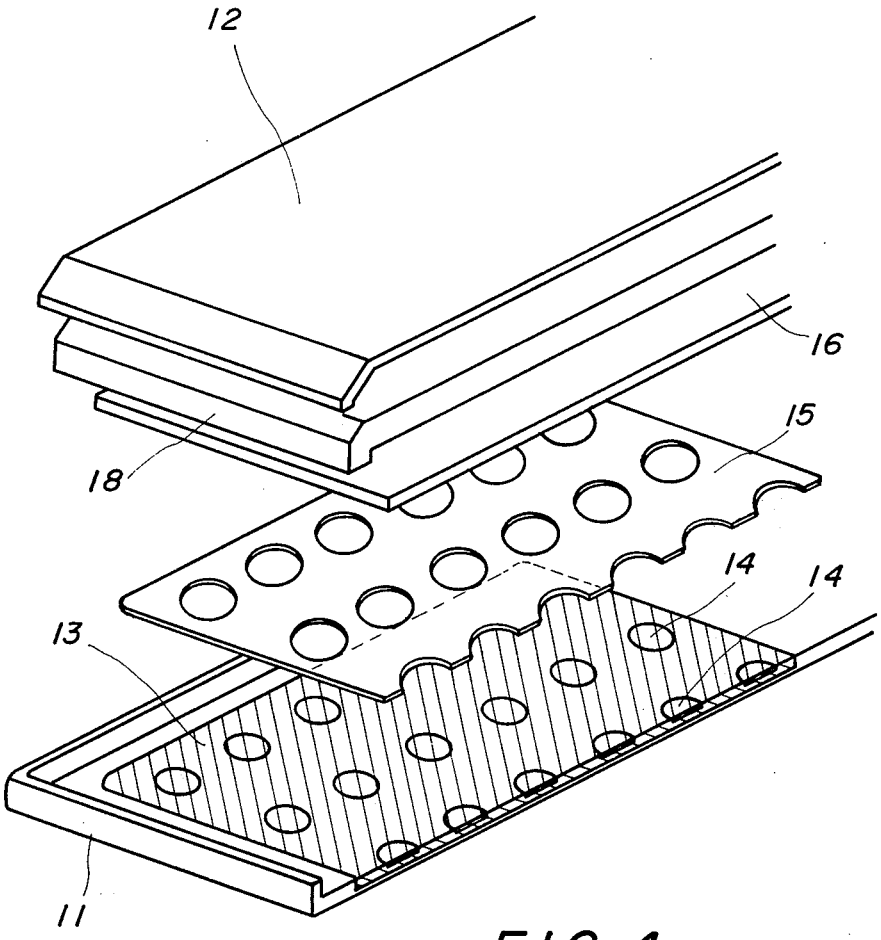
FIG. 4 is a segmented view of another preferred form of the present invention.

In FIG. 4 there is seen a segmented view of the subject electronic apparatus of the present invention comprising the upper member 11 of metallic material integral with a nonconductive silicon rubber sheet 13 and the conductive rubber sheet 14 as a unit. The circuit board 16 is provided spaced from the conductive rubber sheet 14 by spacer member 15. Next is represented a reinforcing frame 18 which serves to secure the components of the instant electronic apparatus between the upper member 11 and lower member 12.

The invention being thus described, it will be obvious that the same may be varied in many ways. Such modifications are not to be regarded as a departure from the spirit and scope of the invention, and all such modifications are intended to be included within the scope of the following claims.

I claim:

1. An electronic apparatus with a flat key-board, comprising:

a housing for said electronic apparatus having an upper metallic member which defines said flat key-board and a lower member, said metallic upper member of said housing, including a plurality of definable movable key actuators in selected regions of the upper surface thereof, and completely integral and continuous therewith said key actuators having a substantially reduced thickness relative to said upper member, thereby making the key actuators movable, relative to said upper member;

a plurality of movable contacts corresponding to respective key actuators for movement in response to the actuation of said key actuators; and a plurality of stationary contacts corresponding to said movable contacts and accommodated within said housing, whereby a particular one of said movable contacts comes into contact with a particular one of said stationary contacts when a particular one of said key actuators is depressed.

2. The electronic apparatus according to claim 1, wherein said upper member of the housing is made of stainless steel and the thickness of said plurality of key actuators is reduced by etching techniques.

3. The electronic apparatus according to claim 1, wherein said upper member of the housing is grounded for electrostatic protection.

4. The electronic apparatus according to claim 1, wherein key actuator markings are formed on one major surface of said upper member of the housing.

5. The electronic apparatus according to claim 1, wherein said movable contacts are bonded or attached to said key actuators.

6. The apparatus as disclosed in claim 1, further including etching means for forming key indicia on the surface of the key actuators.

7. The electronic apparatus of claim 1, wherein the thickness of the key actuator is about 0.025 to 0.03 mm.

8. A hand-held electronic calculator with a flat key-board, comprising:

a housing for said calculator having an upper metallic member which defines said flat key-board and a lower member, said metallic upper member of said housing, including a plurality of definable movable key actuators in selected regions of the upper surface thereof, and completely integral and continuous therewith said key actuators having a substantially reduced thickness relative to said upper member, thereby making the key actuators movable, relative to said upper member;

a plurality of movable contacts corresponding to respective key actuators for movement in response to the actuation of said key actuators; and a plurality of stationary contacts corresponding to said movable contacts and accommodated within said housing, whereby a particular one of said movable contacts comes into contact with a particular one of said stationary contacts when a particular one of said key actuators is depressed.

* * * * *